US008016046B2

(12) United States Patent
Zhao et al.

(10) Patent No.: US 8,016,046 B2
(45) Date of Patent: Sep. 13, 2011

(54) COMBUSTION POWER SOURCE WITH BACK PRESSURE RELEASE FOR COMBUSTION POWERED FASTENER-DRIVING TOOL

(75) Inventors: Hanxin Zhao, Northbrook, IL (US); Marc Largo, Gurnee, IL (US)

(73) Assignee: Illinois Tool Works Inc., Glenview, IL (US)

( * ) Notice: Subject to any disclaimer, the term of this patent is extended or adjusted under 35 U.S.C. 154(b) by 183 days.

(21) Appl. No.: 12/209,831

(22) Filed: Sep. 12, 2008

(65) Prior Publication Data

US 2010/0065602 A1 Mar. 18, 2010

(51) Int. Cl.
*B25B 31/00* (2006.01)

(52) U.S. Cl. ..... 173/1; 227/9; 227/131

(58) Field of Classification Search ..... 227/9, 10, 227/131, 130; 123/46 SC; 173/1
See application file for complete search history.

(56) References Cited

U.S. PATENT DOCUMENTS

| | | | | |
|---|---|---|---|---|
| 3,042,008 | A * | 7/1962 | Liesse | 123/46 SC |
| 3,438,449 | A * | 4/1969 | Smith | 173/17 |
| 3,567,098 | A | 3/1971 | Maynard | |
| RE27,207 | E * | 10/1971 | Ramspeck | 91/356 |
| 4,717,060 | A | 1/1988 | Cotta | |
| 4,739,915 | A | 4/1988 | Cotta | |
| 5,558,264 | A | 9/1996 | Weinstein | |
| 5,671,880 | A * | 9/1997 | Ronconi | 227/130 |
| 6,016,945 | A | 1/2000 | Phillips et al. | |
| 6,095,392 | A | 8/2000 | Batts, Jr. et al. | |
| 6,145,727 | A * | 11/2000 | Mukoyama et al. | 227/130 |
| 6,260,519 | B1 | 7/2001 | Phillips | |
| 7,040,521 | B2 | 5/2006 | Kolodziej et al. | |
| 7,063,052 | B2 | 6/2006 | Nishikawa et al. | |
| 7,063,053 | B2 | 6/2006 | Hirai et al. | |
| 7,201,301 | B2 | 4/2007 | Moeller et al. | |
| 7,210,431 | B2 | 5/2007 | Nishikawa et al. | |
| 7,314,025 | B2 | 1/2008 | Shkolnikov et al. | |
| 7,377,413 | B2 * | 5/2008 | Wen | 227/8 |
| 7,451,903 | B2 * | 11/2008 | Aihara | 227/130 |
| 2008/0023519 | A1 * | 1/2008 | Aihara | 227/130 |
| 2008/0169326 | A1 | 7/2008 | Moeller et al. | |

FOREIGN PATENT DOCUMENTS

| | | |
|---|---|---|
| EP | 1 914 041 | 4/2008 |
| WO | WO 2008/029901 | 3/2008 |

* cited by examiner

*Primary Examiner* — Rinaldi I Rada
*Assistant Examiner* — Nathaniel Chukwurah
(74) *Attorney, Agent, or Firm* — Greer, Burns & Crain, Ltd.

(57) ABSTRACT

A combustion tool includes a cylinder having a lower end provided with a resilient bumper, a piston dimensioned for reciprocation within the cylinder to impact the bumper at an end of the cylinder and having a driver blade depending therefrom for impacting fasteners. At least one back pressure release opening is disposed in the cylinder to be in alignment with the piston and to be closed by the piston when the piston impacts the bumper.

16 Claims, 5 Drawing Sheets

COMBUSTION POWER SOURCE WITH BACK PRESSURE RELEASE FOR COMBUSTION POWERED FASTENER-DRIVING TOOL

BACKGROUND

The present invention relates generally to fastener-driving tools used to drive fasteners into workpieces, and specifically to combustion-powered fastener-driving tools, also referred to as combustion tools or combustion nailers.

Combustion-powered tools are known in the art, and one type of such tools, also known as IMPULSE® brand tools for use in driving fasteners into workpieces, is described in commonly assigned patents to Nikolich U.S. Pat. Re. No. 32,452, and U.S. Pat. Nos. 4,522,162; 4,483,473; 4,483,474; 4,403,722; 5,197,646; 5,263,439 and 6,145,724, all of which are incorporated by reference herein. Similar combustion-powered nail and staple driving tools are available commercially from ITW-Paslode of Vernon Hills, Ill. under the IMPULSE® and PASLODE® brands.

Such tools incorporate a tool housing enclosing a small internal combustion engine. The engine is powered by a canister of pressurized fuel gas, also called a fuel cell. A battery-powered electronic power distribution unit produces a spark for ignition, and a fan located in a combustion chamber provides for both an efficient combustion within the chamber, while facilitating processes ancillary to the combustion operation of the device. Such ancillary processes include: inserting the fuel into the combustion chamber; mixing the fuel and air within the chamber; and removing, or scavenging, combustion by-products. The engine includes a reciprocating piston with an elongated, rigid driver blade disposed within a single cylinder body.

Upon the pulling of a trigger switch, which causes the spark to ignite a charge of gas in the combustion chamber of the engine, the combined piston and driver blade is forced downward to impact a positioned fastener and drive it into the workpiece. The piston then returns to its original, or pre-firing position, through differential gas pressures within the cylinder. Fasteners are fed magazine-style into the nosepiece, where they are held in a properly positioned orientation for receiving the impact of the driver blade.

Conventional combustion tools have been provided with back pressure release openings located at a lower end of the cylinder adjacent the bumper. It has been found that these openings allow the escape to ambient of air pushed in front of the advancing piston. By removing this trapped air from the cylinder, back pressure on the piston is reduced and the fastener driving power of the piston is increased. However, the reduction of back pressure also means that the piston engages the bumper with greater force. Thus, when standard fasteners are driven into standard substrates, such as plywood and construction grade lumber, the force is largely absorbed by the fastener. However, over time, it has been found that increased impact of the piston on the bumper can cause shock impact-related damage to the tool, particularly when relatively short fasteners are driven, and/or when the fasteners are driven into relatively soft substrates. Such damage includes, among other things, premature component failure due to the excess energy being absorbed by the tool.

SUMMARY

The above-listed design issues are addressed by the present combustion tool, which features back pressure release openings located at a lower end of the cylinder, positioned to retain a residual amount of back pressure on the piston. The openings are located to be generally coplanar with, or aligned with the piston as it impacts the bumper. As the piston passes the openings, they are sealed, retaining a residual volume of air between the piston and the lower end of the cylinder. This residual volume of air creates a dampening effect on the advancing piston, which works in conjunction with the bumper to reduce shock impact.

More specifically, a combustion tool includes a cylinder having a lower end provided with a resilient bumper, a piston dimensioned for reciprocation within the cylinder to impact the bumper at an end of the cylinder and having a driver blade depending therefrom for impacting fasteners. At least one back pressure release opening is disposed in the cylinder to be in alignment with the piston and to be closed by the piston when the piston impacts the bumper.

In another embodiment, a combustion tool includes a cylinder having a lower end provided with a resilient bumper, a piston dimensioned for reciprocation within the cylinder and having a driver blade depending therefrom for impacting fasteners. At least one back pressure release opening is disposed in the cylinder for releasing back pressure on the piston, but retaining a residual volume of air to provide dampening to the piston as the bumper is impacted.

In yet another embodiment, a method for reducing combustion-generated back pressure in a combustion tool including a cylinder having a lower end provided with a resilient bumper, a piston dimensioned for reciprocation within the cylinder and having a driver blade depending therefrom for impacting fasteners, and at least one back pressure release opening disposed in the cylinder for releasing back pressure on the piston, the method including positioning the at least one back pressure release opening to correspond with a position of the piston as it impacts the bumper; and reducing a volume defined between the piston and a bottom of the cylinder by at increasing at least one of piston profile and bumper profile.

DETAILED DESCRIPTION

Figure 1:
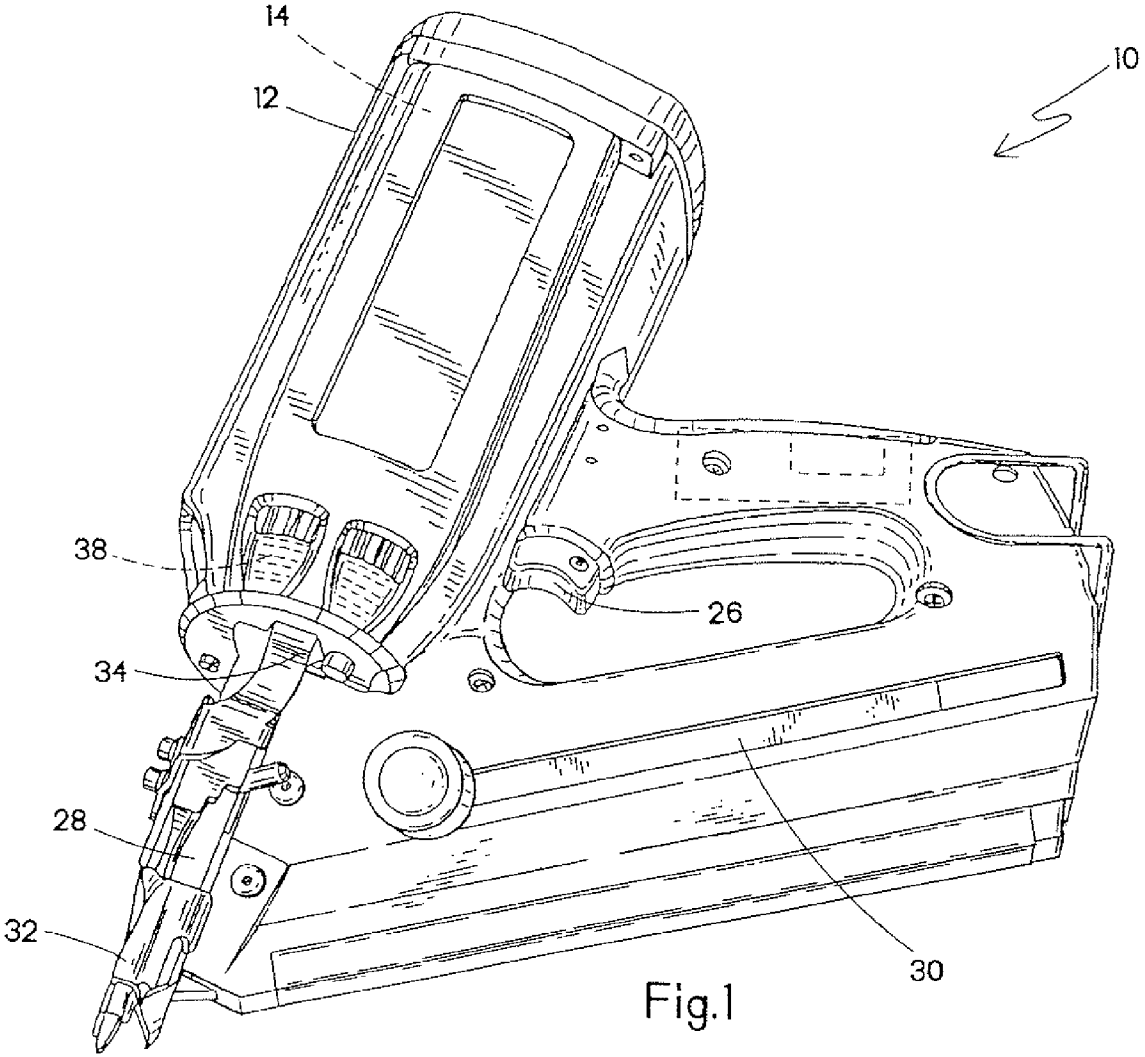
FIG. 1 is a top perspective view of a combustion tool suitable for use with the present combustion engine; incorporating the present driver blade.
Figure 2:
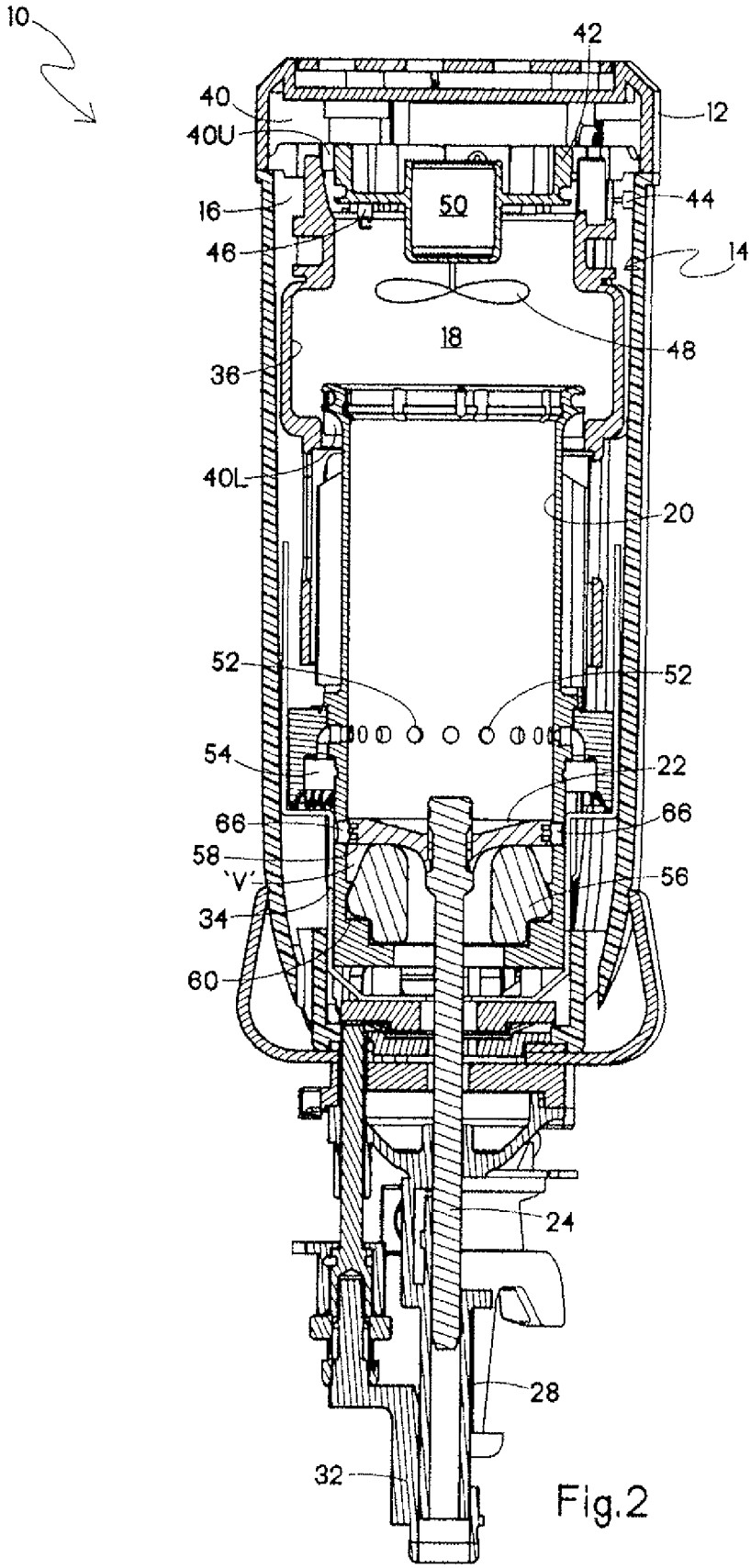
FIG. 2 is a fragmentary front vertical section of the combustion-powered fastener-driving tool of FIG. 1.

Referring now to FIGS. 1 and 2, a combustion-powered fastener-driving tool incorporating the present control system is generally designated 10 and preferably is of the general type described in detail in the patents listed above and incorporated by reference in the present application. A housing 12 of the tool 10 encloses a self-contained internal power source 14 (FIG. 2) within a housing main chamber 16. As in conventional combustion tools, the power source 14 is an internal combustion engine and includes a combustion chamber 18 that communicates with a cylinder 20. A piston 22 reciprocally disposed within the cylinder 20 is connected to the upper end of a driver blade 24.

Through depression of a trigger 26 associated with a trigger switch (not shown), an operator induces combustion within the combustion chamber 18, causing the driver blade 24 to be forcefully driven downward through a nosepiece 28 (FIG. 1). The nosepiece 28 of FIG. 2 is slightly modified from that of FIG. 1 but does not influence the operation of the present combustion engine 14. The nosepiece 28 guides the driver blade 24 to strike a fastener that had been delivered into the nosepiece via a fastener magazine 30.

Included in the nosepiece 28 is a workpiece contact element 32, which is connected, through a linkage 34 to a reciprocating valve sleeve 36, an upper end of which partially defines the combustion chamber 18. Depression of the tool housing 12 against the workpiece contact element 32 in a downward direction as seen in FIG. 1 (other operational orientations are contemplated as are known in the art), causes the workpiece contact element 32 to move from a rest position to a pre-firing position. This movement overcomes the normally downward biased orientation of the workpiece contact element 32 caused by a spring 38 (shown hidden in FIG. 1). Other locations for the spring 38 are contemplated.

Through the linkage 34, the workpiece contact element 32 is connected to and reciprocally moves with, the valve sleeve 36. In a rest position, the combustion chamber 18 is not sealed, since there is an annular gap 40 including an upper gap 40U separating the valve sleeve 36 and a cylinder head 42, which accommodates a chamber switch 44 and a spark plug 46, and a lower gap 40L separating the valve sleeve 36 and the cylinder 20. In the preferred embodiment of the present tool 10, the cylinder head 42 also is the mounting point for at least one cooling fan 48 and the associated fan motor 50 which extends into the combustion chamber 18 as is known in the art and described in the patents which have been incorporated by reference above. In the rest position depicted in FIG. 2, the tool 10 is disabled from firing because the combustion chamber 18 is not sealed at the top with the cylinder head 42 and the chamber switch 44 is open.

Firing is enabled when an operator presses the workpiece contact element 32 against a workpiece. This action overcomes the biasing force of the spring 38, causes the valve sleeve 36 to move upward relative to the housing 12, closing the gap 40, sealing the combustion chamber 18 and activating the chamber switch 44. This operation also induces a measured amount of fuel to be released into the combustion chamber 18 from a fuel canister (not shown). A plurality of exhaust ports 52 are provided in the cylinder 20 and are in communication with petal valves 54 to remove spent exhaust gases post combustion.

Figure 3:
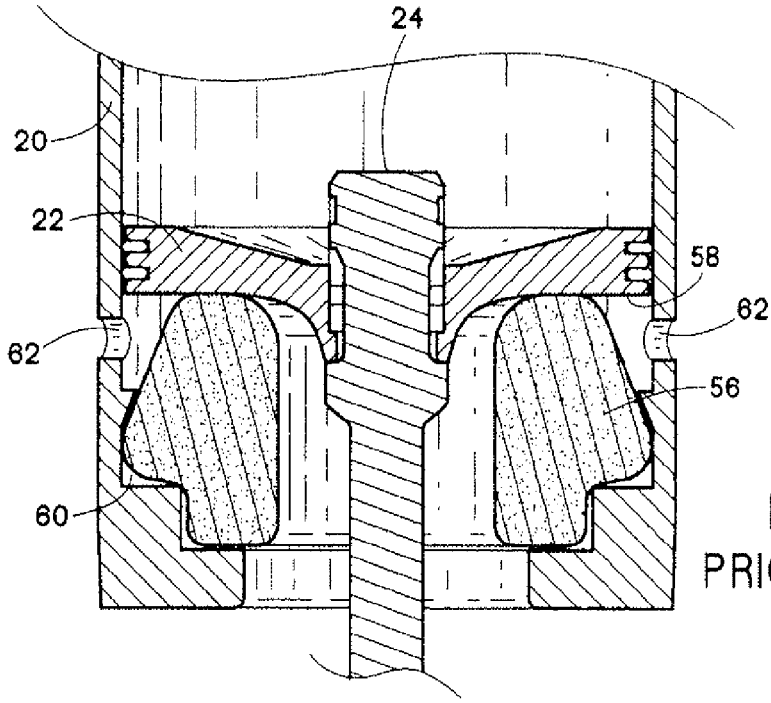
Fig.3 PRIOR ART
FIG. 3 is a fragmentary vertical section of a prior art combustion engine provided with back pressure release openings near the lower end of the cylinder.

Referring now to FIG. 3, a prior art configuration is shown. Despite the existence of exhaust ports 52 in the cylinder 20 which are equipped with the petal valves 54, after combustion, as the piston 22 moves down the cylinder 20 toward a resilient annular bumper 56, a significant amount of back-pressure develops between a lower face 58 of the piston and a bottom or lower end 60 of the cylinder. This back pressure impedes piston travel and accordingly reduces tool driving power.

Tool designers have recently addressed the issue of back pressure on the piston by providing back pressure release holes 62 in the cylinder 20. The holes 62 are located below an upper edge 64 of the bumper 56 and below the lowest point of travel of the piston 22. As designed, these holes 62 allow the release of the built up back pressure as the piston 22 advances toward the bumper 56, and a corresponding increase in tool power is achieved. However, an unintended drawback of the provision of the release holes 62 is that when the tool 10 is used to drive relatively short fasteners, and/or the substrate or workpiece is relatively soft, the excess drive energy is absorbed by the tool, and the resulting high stresses in some cases result in tool component failure. It is contemplated that the back pressure eliminated by the release holes 62 provided a dampening effect on the piston which prevented the failures now encountered.

Figure 4:
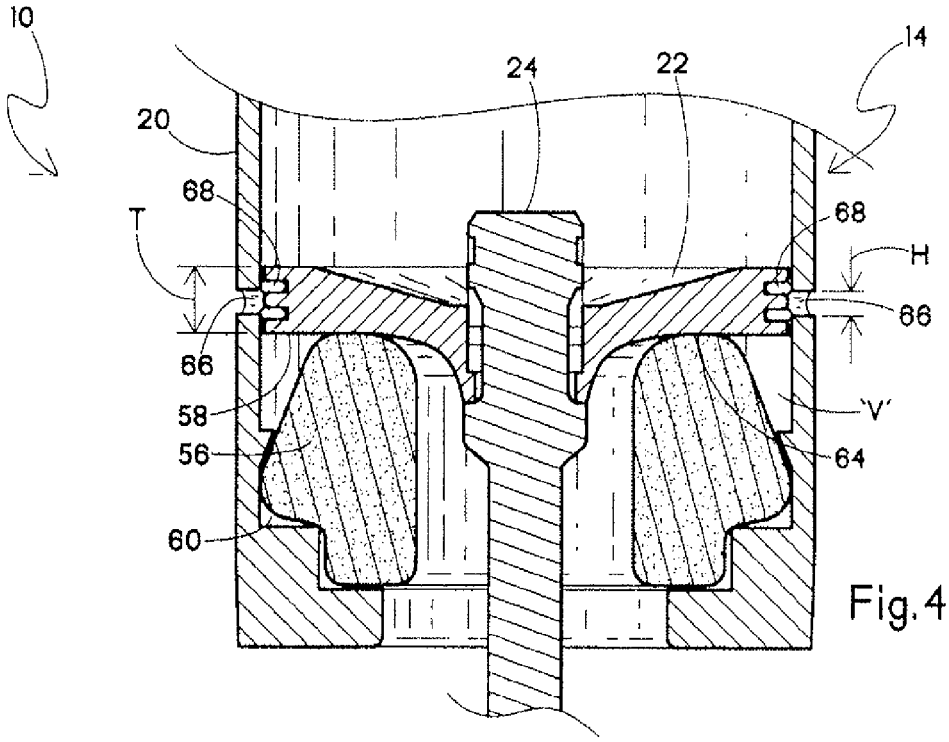
FIG. 4 is a fragmentary vertical section of the present combustion engine provided with back pressure release openings adjacent the point where the piston engages the bumper.

Referring now to FIG. 4, an important feature of the present combustion tool 10 is that the combustion engine 14 is provided with at least one and preferably a plurality of back pressure release openings 66 placed generally coplanar with, or in alignment with the piston 22 when it reaches the bottom of its travel and strikes the bumper 56. Thus, the openings 66 allow the release of back pressure as the piston 22 approaches the bumper, increasing tool power or driving energy compared to conventional combustion tool designs. However, as the piston 22 impacts the bumper 56, the piston temporarily closes and preferably seals the openings 66, thus trapping a residual amount of air in a volume 'V' to provide a dampening effect. The compressed dampening volume 'V' is sufficient to dampen the impact of the piston 22 upon the bumper 56, and is considered sufficient to prevent premature tool failure when relatively short fasteners are driven, or when the substrate or workpiece is relatively soft.

In the preferred embodiment, the openings 66 are provided in a spaced array around the cylinder 20 at the point where the piston 22 impacts the bumper 56. The shape of the openings 66 may vary to suit the situation, and rectangular or circular openings are preferred. The openings 66 are shown rectangular in FIG. 4 and circular in FIGS. 5 and 6. As is known in the art, the piston 22 is typically provided with at least one and preferably a pair of seal rings 68. It is preferred that a height 'H' of the openings 66 be less than or equal to the distance between the two rings 68, so that when the piston 20 is aligned with the openings, the piston seal rings seal the openings from ambient. More specifically, as the piston 22 strikes the bumper 56, an upper piston ring is located above a margin of the opening, and a lower piston ring is located below a margin of the opening to maintain a sealed condition above the piston, and preventing escape of residual air located between the piston and the bottom 60 of the cylinder.

Some variation in the height 'H' is contemplated, to accommodate piston travel and compression of the bumper as the piston 22 impacts and rebounds from the bumper 56. Thus, a preferred range of the height 'H' is represented by the distance 'T', which is preferably less than or equal to a height or thickness of the piston 22. A preferred piston height, which corresponds with 'T' in FIG. 4, is 0.0300 inch, however other dimensions are contemplated. It is also preferred that 'H' not be too small, since with reduced height the release function is impaired. A lower limit of the distance 'T' is a function of the reciprocal travel distance of the piston 22 as it impacts the bumper 56 and rebounds on its way back up the cylinder 20. Due to the balancing of the desired objectives of obtaining sufficient back pressure release and maintenance of a dampening volume, the height 'H' may vary to suit the performance of a particular tool provided it is preferably not higher than the piston height. In cases where the piston 22 has only one seal ring 68, the value of 'H' will be reduced from that described above to achieve both desired objectives.

Figure 5:
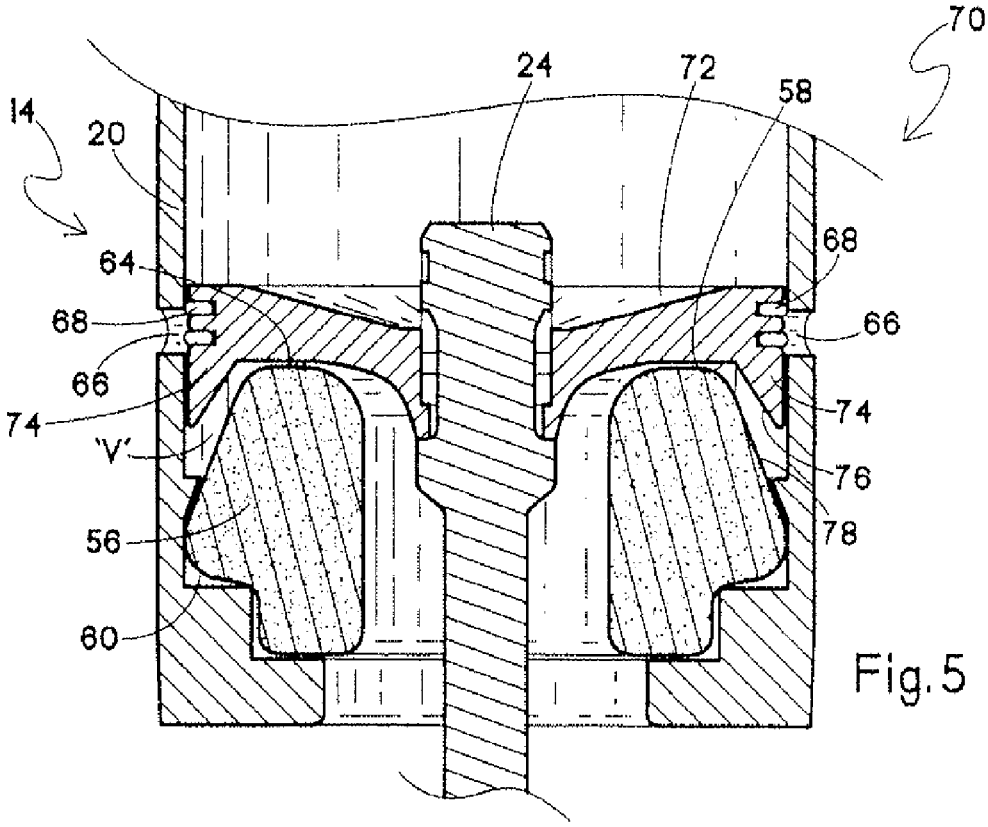
FIG. 5 is a fragmentary vertical section of an alternate embodiment of the present combustion engine provided with a modified piston configuration shown in a pre compression position.
Figure 6:
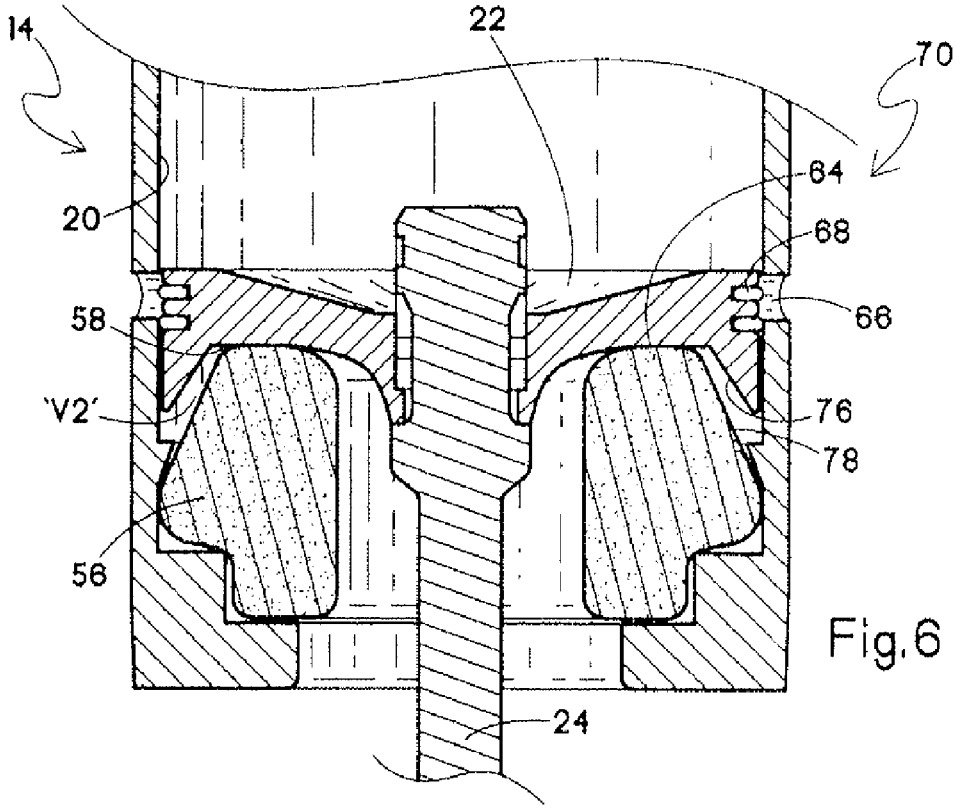
FIG. 6 is a fragmentary vertical section of the embodiment of FIG. 5 shown in a post compression position.

Referring now to FIGS. 5 and 6, an alternate embodiment of the present tool is generally designated 70. Components shared with the tool 10 are designated with the same reference numbers. The main distinction of the tool 70 is that a piston 72 is provided having a dampening formation 74 depending from the lower face 58 of the piston. A main purpose of the dampening formation 74, shown as a ring, is to reduce the volume 'V' and accordingly generate increased dampening action. As such, the specific shape of the formation 74 may change to suit the situation. However, it is preferred that the dampening formation 74 is provided with an angled leading edge 76 configured to complement the opposing profile 78 of the bumper 56 as seen in FIGS. 5 and 6.

As seen in FIG. 6, as the piston 72 reaches its lowest travel limit, the compressed volume 'V2' is reduced compared to the volume 'V', thus increasing the pressure and the dampening action. Also, it will be seen that a lower seal ring 68 on the piston 22 is engaged with the cylinder 20, sealing the volume 'V2' from ambient.

Figure 7:
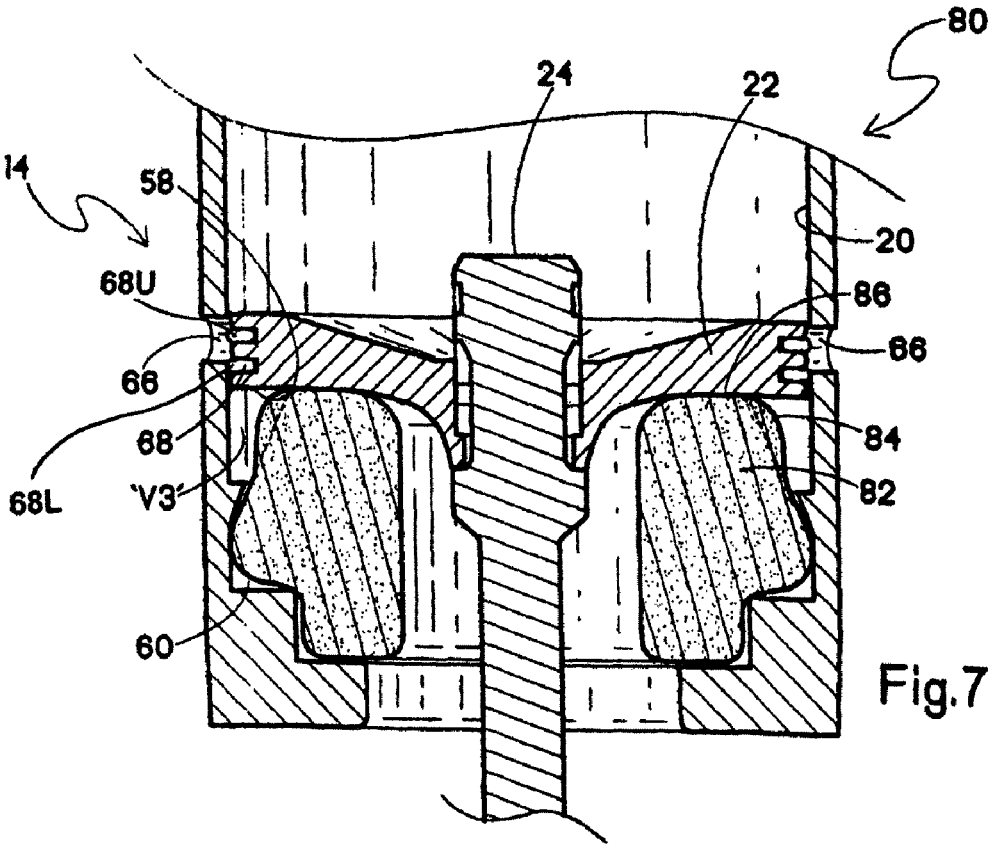
FIG. 7 is a fragmentary vertical section of another alternate embodiment of the present combustion engine provided with a modified bumper.

Referring now to FIG. 7, another alternate embodiment of the present tool is generally designated 80. Components shared with the embodiments 10 and 70 are designated with identical reference numbers. The main distinction of the tool 80 is that a bumper 82 is provided having an increased volume compared to conventional bumpers. More specifically, an outer profile 84 of the bumper 82 defines a general normal or right angle profile along an upper exterior edge, with the conventional bumper profile shown in broken lines. Also, an upper edge 86 is generally parallel with the opposing piston lower face 58. As is the case with the tool 70, this enlarged bumper profile 84 decreases the trapped volume below the piston 24, creating a volume 'V3' that has a higher compression and provides increased dampening force. In view of the embodiments 70 and 80, it will be understood that the volume 'V' can be reduced by increasing the piston profile, the bumper profile, or combinations of the two.

Figure 8:
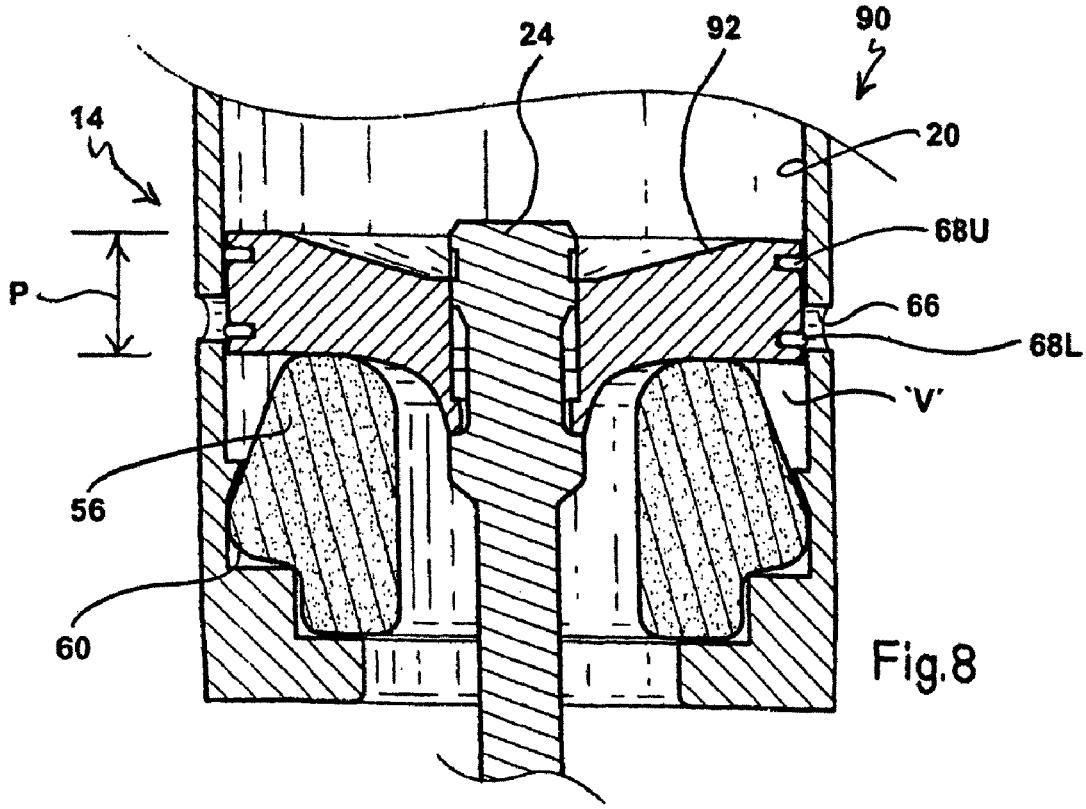
FIG. 8 is a fragmentary vertical section of still another alternate embodiment of the present combustion engine provided with a modified piston.

Referring now to FIGS. 7 and 8, it will be seen that as the piston 22 passes the openings 66, the lower piston seal ring 68L is in sealing contact with the cylinder 20, however the upper piston seal ring 68U has passed an upper edge of the opening, and as such has allowed the cylinder above the piston to be exposed to ambient. While only a temporary condition, in some cases such exposure may interfere with the creation and maintenance of the vacuum used to ensure piston return at the end of the combustion cycle.

To maintain a sealing relationship above and below the piston as the piston impacts the bumper 56, an alternate embodiment of the present tool is provided and is generally designated 90. In the embodiment 90, components shared with the previous embodiments are designated with identical reference numbers. A main distinction of the tool 90 is that a piston 92 is provided with an increased thickness or height "P". While the piston 92 depicted is somewhat exaggerated for purposes of explanation, the height "P" is sufficient to maintain a sealing relationship between the upper piston seal ring 68U and the cylinder 20 during the travel cycle of the piston, regardless of whether it is against, compressing or away from the bumper 56 in the vicinity of the openings 66. As such, it will be appreciated that the height "P" of the piston 92 may vary to suit the application, provided the sealing relationship is maintained between the upper seal ring 68U and the cylinder 20 at an upper margin of the opening 66. As shown in FIG. 8, the piston 92 has just contacted the bumper 56 and as such has not yet compressed the bumper, while the lower piston ring 68L is about to seal the volume 'V' as it progresses past the openings 66 to reach and seal a lower margin of the opening as seen in FIG. 4. Once the volume V is sealed, the vacuum will be maintained above the piston 92, thus facilitating piston return.

While a particular embodiment of the present combustion power source with back pressure release for a combustion-powered fastener-driving tool has been described herein, it will be appreciated by those skilled in the art that changes and modifications may be made thereto without departing from the invention in its broader aspects and as set forth in the following claims.

The invention claimed is:

1. A fastener driving tool, comprising:

a cylinder having a lower end provided with a resilient bumper;

a piston dimensioned for reciprocation within said cylinder to impact said bumper at an end of said cylinder and having a driver blade depending therefrom for striking fasteners; and at least one back pressure release opening disposed in said cylinder to be in alignment with said piston, each said opening being closed by said piston to seal said cylinder from air loss as said piston impacts said bumper, wherein said at least one back pressure release opening is constructed and arranged so that upon said piston impacting said bumper and closing said at least one opening, a residual volume of air is trapped in said sealed cylinder below said piston to dampen impact of said piston upon said bumper.

2. The tool of claim 1 further including a plurality of said openings spaced about said cylinder.

3. The tool of claim 1 wherein said at least one opening is dimensioned to have a height approximately less than or equal to a height of said piston.

4. The tool of claim 3 wherein said piston has a pair of spaced seal rings, and said at least one opening has a height less than or equal to a distance between said rings so that at least one of an upper seal ring seals an upper margin of said at least one opening, and a lower seal ring seals a lower margin of said at least one opening as said piston impacts said bumper.

5. The tool of claim 1 wherein said at least one release opening is constructed and arranged so that when said piston impacts said bumper, said cylinder is sealed from ambient air loss, both above and below said piston.

6. The tool of claim 1 wherein said bumper is provided with a generally normal profile of an upper exterior dimension which increases bumper volume.

7. The tool of claim 1 further including a dampening formation provided to a lower side of said piston.

8. The tool of claim 7 wherein said dampening formation has a shape which complements a profile of said bumper.

9. A fastener driving tool, comprising:

a cylinder having a lower end provided with a resilient bumper;

a piston dimensioned for reciprocation within said cylinder and having a driver blade depending therefrom for impacting fasteners, and a pair of spaced seal rings; and at least one back pressure release opening disposed in said cylinder for releasing back pressure on said piston and having a height approximately less than or equal to a height of said piston, said piston configured to block each said opening to seal said cylinder from air loss as said bumper is impacted for retaining a residual volume of air for providing dampening to said piston, said at least one opening having a height less than or equal to a distance between said rings so that at least one of an upper seal ring seals an upper margin of said at least one opening, and a lower seal ring seals a lower margin of said at least one opening as said piston impacts said bumper.

10. The tool of claim 9 wherein said at least one back pressure release opening is disposed on said cylinder to be closed by said piston as said piston impacts said bumper.

11. The tool of claim 9 wherein said bumper is provided with a generally normal profile of an upper exterior dimension which increases bumper volume.

12. The tool of claim 9 further including a dampening formation provided to a lower side of said piston which complements an opposing profile of said bumper.

13. A method for reducing combustion-generated back pressure in a combustion tool including a cylinder having a lower end provided with a resilient bumper, a piston dimensioned for reciprocation within the cylinder and having a driver blade depending therefrom for impacting fasteners, and at least one back pressure release opening disposed in the cylinder for releasing back pressure On the piston, said method comprising:

positioning the at least one back pressure release opening to correspond with a position of the piston as it impacts the bumper, wherein each said opening is blocked by said piston to seal the cylinder from air loss upon said impact of the bumper; and reducing a volume defined between the piston and the lower end of the cylinder by increasing at least one of piston profile and bumper profile.

14. The method of claim 13 further including providing said piston with at least one seal ring constructed and arranged to maintain a sealing relationship with the cylinder above the at least one back pressure release opening to maintain a seal as the piston impacts, compresses and returns from the bumper.

15. The method of claim 13 further including providing said piston with at least one seal ring constructed and arranged to maintain a sealing relationship below the at least one back pressure release opening to maintain a seal as the piston impacts, compresses and returns from the bumper.

16. The method of claim 13 further including providing said piston with at least one seal ring constructed and arranged to maintain a sealing relationship above the at least one back pressure release opening to maintain a seal as the piston impacts, compresses and returns from the bumper, and at least one seal ring constructed and arranged to maintain a sealing relationship below the at least one back pressure release opening to maintain a seal as the piston impacts, compresses and returns from the bumper.

* * * * *